US006776668B1

(12) United States Patent
Scyoc et al.

(10) Patent No.: US 6,776,668 B1
(45) Date of Patent: Aug. 17, 2004

(54) LOW PROFILE COAXIAL BOARD-TO-BOARD CONNECTOR

(75) Inventors: William Crusey Van Scyoc, Shippensburg, PA (US); Michael John Phillips, Camp Hill, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/667,927

(22) Filed: Sep. 22, 2003

Related U.S. Application Data

(60) Provisional application No. 60/491,949, filed on Aug. 1, 2003.

(51) Int. Cl.[7] ..... H01R 13/24

(52) U.S. Cl. ..... 439/700; 439/66; 439/83; 439/295

(58) Field of Search ..... 439/66, 700, 83, 439/295

(56) References Cited

U.S. PATENT DOCUMENTS

| | | | | |
|---|---|---|---|---|
| 4,983,133 | A | | 1/1991 | Van Scyoc et al. |
| 5,516,303 | A | | 5/1996 | Yohn et al. |
| 6,053,777 | A | * | 4/2000 | Boyle ..... 439/700 |
| 6,340,320 | B1 | * | 1/2002 | Ogawa ..... 439/824 |
| 6,343,958 | B1 | * | 2/2002 | Wayman ..... 439/700 |
| 6,350,155 | B1 | * | 2/2002 | Mullinger-Bausch et al. ..... 439/675 |
| 6,464,511 | B1 | * | 10/2002 | Watanabe et al. ..... 439/66 |
| 6,558,177 | B2 | * | 5/2003 | Havener et al. ..... 439/246 |

* cited by examiner

*Primary Examiner*—Truc Nguyen

(57) ABSTRACT

A low profile electrical connector includes a center contact assembly having an integral housing and a spring loaded plunger contact therein; and a shield assembly coaxial with the center contact assembly. The shield assembly includes a slotted shield base to be coupled stationary to a circuit board, and a contact ring reciprocally mounted to the shield base for relative movement thereto.

25 Claims, 12 Drawing Sheets

LOW PROFILE COAXIAL BOARD-TO-BOARD CONNECTOR

CROSS REFERENCE TO RELATED APPLICATIONS

This application claims the benefit of U.S. Provisional Application Serial No. 60/491,949 filed Aug. 1, 2003, which is hereby incorporated by reference in its entirety.

BACKGROUND OF THE INVENTION

The invention relates generally to electrical connectors, and, more particularly, to coaxial board-to-board connectors.

Coaxial connectors for interconnecting electrical components typically include a conductive signal path and a conductive shield surrounding the signal path. The conductive path through the shield provides a return path through the connector and also prevents radio frequency (RF) leakage from the signal path. Sometimes referred to as RF connectors, coaxial connectors are used with and are employed in a wide variety of electrical and electronic devices and packages.

Like other electrical connectors and components, the increasing miniaturization of modem devices has rendered known coaxial connectors unsuitable for use in smaller and smaller devices and electronic packages. For instance, cellular phones and other hand-held or portable devices are becoming smaller in physical size, while offering a host of expanded features and capabilities. Consequently, internal electronics which make the desired features possible must be crowded into smaller and smaller spaces which are incapable of accommodating known connectors. This problem is especially acute for board-to-board connectors that interconnect circuit boards within the constrained internal space of the device.

One known board-to-board coaxial connector that has been employed in Europe is available from Tyco Electronics as part number 619193. The connector includes a center contact assembly and a shield assembly surrounding the center contact assembly. The center contact assembly includes a two-piece conductive housing mounted to a first circuit board on a lower end, and a spring-loaded plunger contact reciprocally mounted in the housing and extending from an upper end. A ball bearing is employed between an end of the spring and the plunger contact to offset the spring load to the plunger contact within the housing.

The shield of part number 619193 includes a lower contact ring base which is fixedly coupled to a first circuit board, and an upper spring loaded member reciprocally movable within the base and including six longitudinally extending contact beams separated by slots for producing desired impedance and RF characteristics of the connector. The lower end of the center contact assembly housing and the lower contact ring of the shield are fixedly mounted to a first circuit board, and when a second circuit board is brought into contact with the connector, the plunger contact and the upper member of the shield are depressed against the bias of the respective springs, thereby providing a normal contact force against the second circuit board. A signal path and a return path are therefore established between the first and second circuit boards through the center contact assembly and the shield assembly. This construction is disadvantaged, however, in several aspects.

For example, the construction of the coaxial connector of part number 619193 includes at least nine different parts that must be assembled to produce the connector. The connector may therefore be prohibitively expensive for some applications. In a high volume business of producing such connectors, each component adds an incremental cost to the connector that, over a large number of connectors, can be substantial. If the number of components can be reduced and if manufacture of the connector can be simplified, manufacturing efficiency will be improved and cost savings may be realized.

Additionally, the coaxial connector of part number 619193 may accommodate a minimum board-to-board separation of about 6.65 mm and about a two degree misalignment of the first and second boards, thereby rendering the connector unusable for board-to-board clearances below the 6.65 mm threshold and unreliable when a misalignment of the boards is greater than two degrees.

Still further, as the size of the circuit boards is reduced, the space occupied by the connector on a circuit board, sometimes referred to as a "footprint" of the connector, is an important consideration. Reducing the space occupied by a connector can free up valuable board space for other circuit components.

BRIEF DESCRIPTION OF THE INVENTION

According to one exemplary embodiment, a low profile electrical connector comprises a center contact assembly comprising an integral housing and a spring loaded plunger contact therein and a shield assembly coaxial with the center contact assembly. The shield assembly comprises a slotted shield base adapted to be coupled stationary to a circuit board, and a contact ring is reciprocally mounted to the shield base for relative movement thereto.

According to another exemplary embodiment, a low profile coaxial electrical connector comprises a substantially cylindrical center contact assembly comprising an integral conductive housing, a contact plunger reciprocally mounted within the housing, and a first spring. The first spring biases the plunger contact to an extended position relative to the housing, and the plunger contact is depressible against a bias of the first spring to a retracted position. A substantially cylindrical shield assembly is provided coaxial with the center contact assembly, and the shield assembly comprises a slotted shield base having an outer surface and adapted to be fixedly coupled to a circuit board. A contact ring is reciprocally mounted to the shield base and movable thereto, and a second spring biases the contact ring to an extended position relative to the shield base. The contact ring is depressible against a bias of the second spring to a retracted position, wherein the plunger contact and the contact ring are depressed to produce an overall height of the connector of about 4 mm when the plunger contact and the slotted member are in the retracted position.

According to another exemplary embodiment, a low profile coaxial electrical connector comprises a substantially cylindrical center contact assembly comprising an integral conductive housing, a contact plunger reciprocally mounted within the housing, and a first spring. The first spring biases the plunger contact to an extended position relative to the housing, and the plunger contact is depressible against a bias of the first spring to a retracted position. A substantially cylindrical shield assembly is provided coaxial with the center contact assembly, and the shield assembly comprises a slotted shield base having an outer surface and adapted to be fixedly coupled to a circuit board. A contact ring is reciprocally mounted to the shield base and is movable thereto, and a second spring biases the contact ring to an extended position relative to the shield base. The contact ring is depressible against a bias of the second spring to a retracted position, wherein the center contact assembly and the shield assembly are adapted to accept a board-to-board misalignment of about 3 degrees between a first circuit board and second circuit board.

According to another exemplary embodiment, an electronic package is provided. The package comprises a first circuit board and a second board having a separation therebetween and a shield assembly mounted stationary to the fist circuit board. The shield assembly comprises a slotted shield base coupled stationary to the first circuit board, and a contact ring reciprocally mounted to the shield base for relative movement thereto from an extended position relative to the first circuit board to a retracted position when contacted by the second circuit board. A center contact assembly is coaxial with and internal to the shield assembly, and the center contact assembly comprises an integral housing mounted stationary to the first circuit board and a spring loaded plunger contact reciprocally coupled to the housing and movable between an extended position and a retracted position relative to the housing. The plunger contact is depressed by the second circuit board to establish electrical connection therewith.

DETAILED DESCRIPTION OF THE INVENTION

Figure 1:
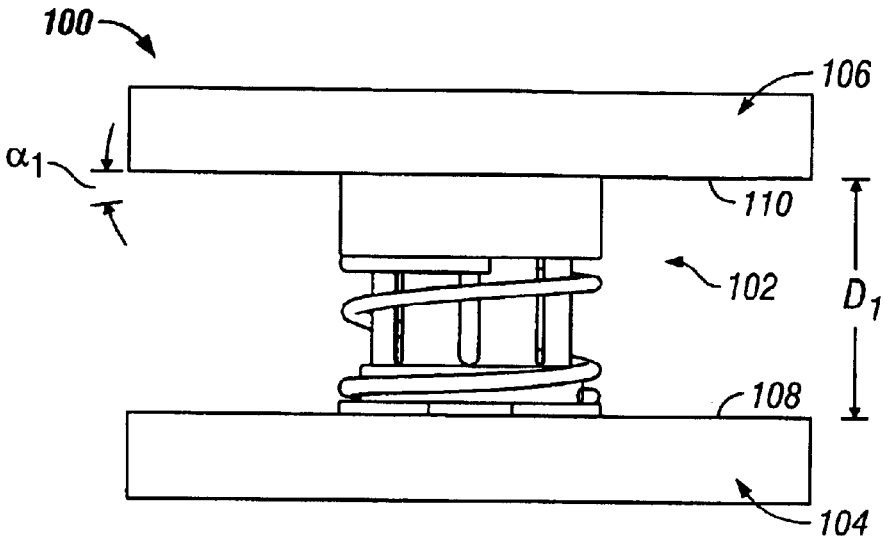
FIG. 1 is a side elevational view of an electronic package including a board-to-board coaxial connector formed in accordance with an exemplary embodiment of the invention.

FIG. 1 is a side elevational view of an electronic package 100 including a board-to-board coaxial connector 102 formed in accordance with an exemplary embodiment of the invention. The connector 102 is positionable in an extended position and a retracted position (shown in FIG. 1) interconnecting a base circuit board 104 and a target circuit board 106 which are separated by a distance $D_1$ measured substantially perpendicular to a top surface 108 of the base circuit board 104 and a bottom surface 110 of the target board 106. In an exemplary embodiment, and unlike known coaxial connectors, the connector 102 has a compact low profile capable of accommodating a board-to-board separation or clearance $D_1$ of about 4.0 mm while reliably connecting the circuit boards 104 and 106. It is recognized, however, that greater or lesser board separations $D_1$ may be obtained in alternative embodiments of the invention.

Additionally, the connector 102, for the reasons explained below, is capable of establishing the electrical connection between the boards 104, 106 despite some misalignment of the boards 104, 106. For example, if the target board 106 is oriented at an angle $\alpha_1$ relative to a plane parallel to the top surface 108 of the base circuit board 104 an electrical connection may nonetheless be established through the connector 102. In an exemplary embodiment, the value $\alpha_1$ is approximately 3°, which is significantly greater than known coaxial connectors.

Figure 2:
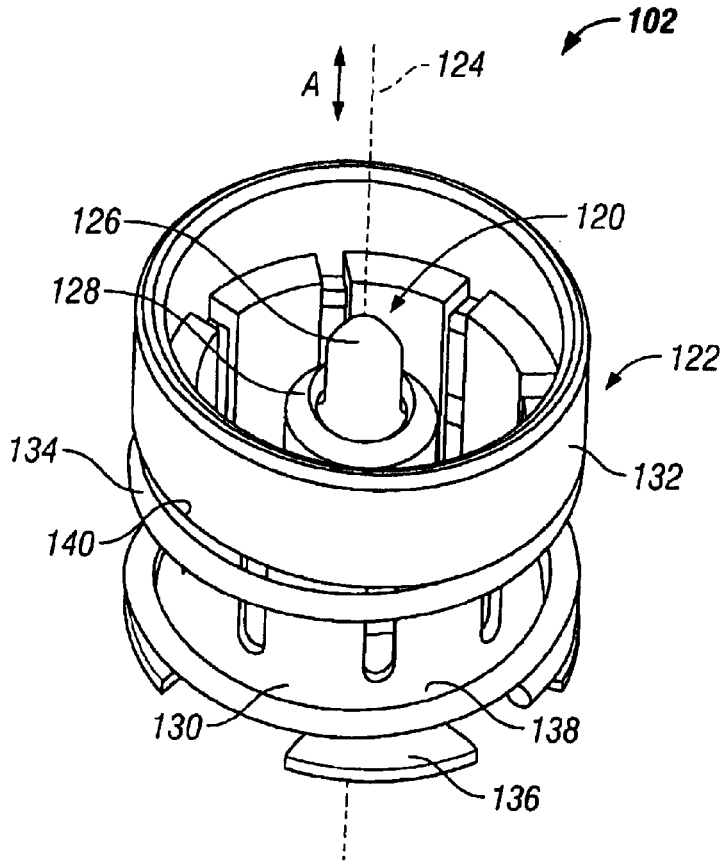
FIG. 2 is a perspective view of the connector shown in FIG. 1.

FIG. 2 is a perspective view of the connector 102 in a relaxed or extended state. The connector 102 includes a conductive center contact assembly 120 and a conductive shield assembly 122 each substantially aligned along a longitudinal axis 124 extending through the connector 102. The center contact assembly 120 provides a signal path through the connector 102 in the manner described further below, and the shield assembly 122 is provided coaxial with the center contact assembly 120 to provide a return path through the connector and to prevent RF leakage from the signal path.

The center contact assembly 120 includes a spring-loaded plunger contact 126 substantially centered within the shield assembly 122 and reciprocally mounted within a housing 128 such that the plunger contact 126 is movable in a direction of arrow A. That is, the plunger contact 126 is reciprocally movable in a direction parallel to the longitudinal axis 124 between the extended position shown in FIG. 2 and the retracted position shown in FIG. 1.

The shield assembly 122 includes a base 130 and a solid contact ring 132 mounted thereto at an upper end. The contact ring 132 is biased to the extended position by a helical compression spring element 134 extending exterior to the base 130. As illustrated in FIG. 2, the base 130 and the contact ring 132 are substantially cylindrical about the longitudinal axis 124, and a lower end of the base 130 opposite the contact ring 132 includes a number of footings 136 which project radially outward from an outer surface 138. An outer surface of the footings 136 forms a seat for one end of the spring element 134 while a lower edge 140 of the contact ring 132 provides a second seat for the spring element 134. The spring element 134 is compressed or loaded during assembly of the connector 102 to provide a biasing force, which, in the absence of an external force applied to the contact ring 132, maintains the contact ring 132 in the extended position.

The contact ring 132, like the plunger contact 126, is movable in a direction of arrow A substantially parallel to the longitudinal axis 124 between the extended position and the retracted position. When the shield base 130 and the housing 128 are mounted stationary to the base circuit board 104 (shown in FIG. 1), the plunger contact 126 and the contact ring 132 may deflect and move downward in the direction of arrow A to establish electrical connection with the target board 106. That is, the plunger contact 126 and the contact ring 132 are respectively depressed within the center contact assembly 120 and the shield assembly 122 to the retracted position. In the retracted position, the plunger contact 126 is depressed relative the housing 128 and the contact ring 132 is depressed relative to the shield base 130.

Figure 3:
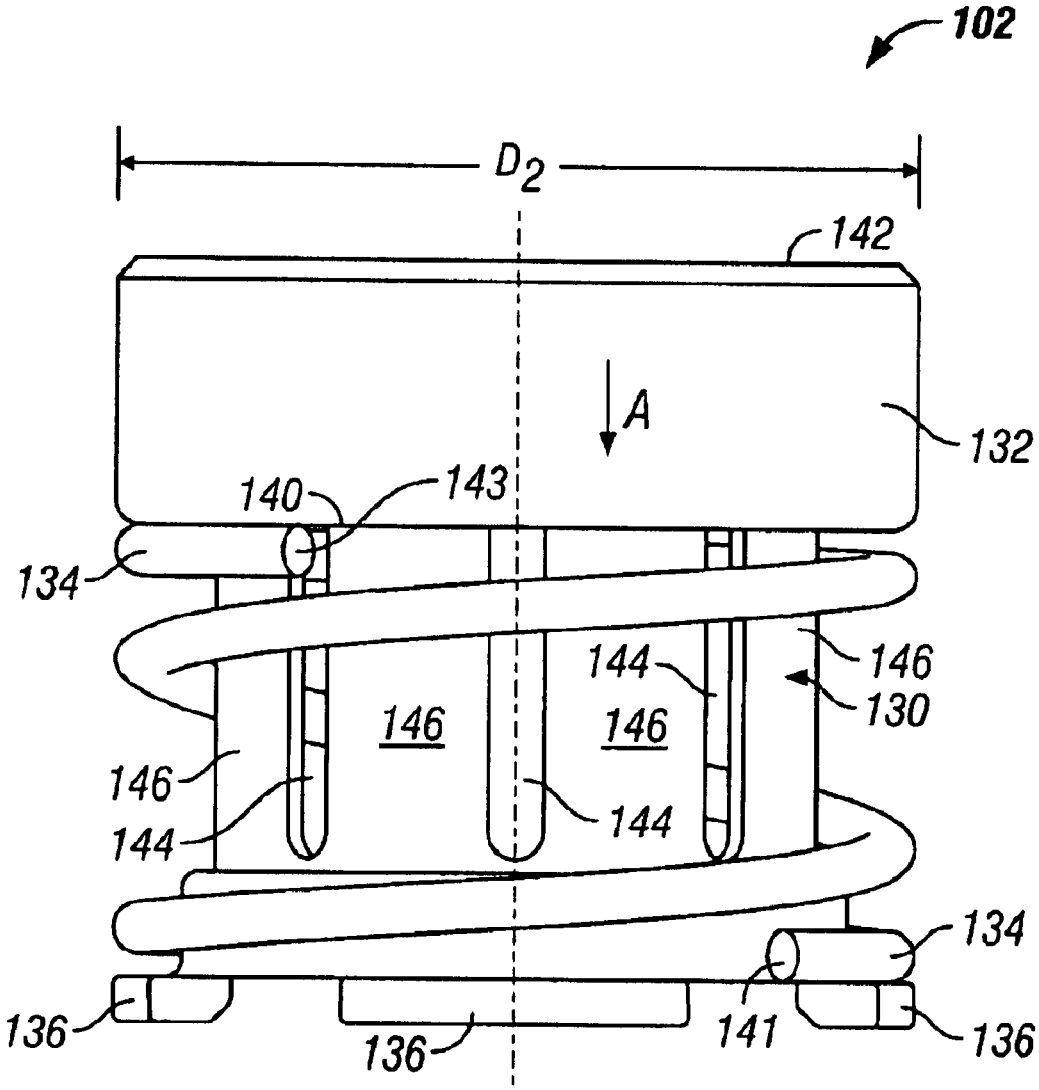
FIG. 3 is a side elevational view of the connector shown in FIG. 2.

FIG. 3 is a side elevational view of the connector 102 in the extended position wherein a first end 141 of the spring element 134 is seated upon one of the footings 136 of the shield base 130 and a second end 143 is seated upon the lower end 140 of the contact ring 132. The bias of the spring element 134 pushes the contact ring 132 upward from the shield base 130 to the extended position. However, when a top surface 142 of the contact ring 132 is engaged by a circuit board, such as the target board 106 (shown in FIG. 1), the contact ring 132 may be moved downward in the direction of arrow A against the bias of the spring element 134, thereby further compressing the spring element 134. Compression of the spring element 134 produces a normal contact force between the target board 106 and the top surface 142 of the contact ring 132.

As also illustrated in FIG. 3, in an exemplary embodiment the shield base 130 includes a number of slots 144 extending therethrough and defining a number of resilient contact beams 146 extending between the slots 144. The slots 144 and beams 146 are provided to facilitate assembly of the shield assembly 122 while achieving desired RF and impedance characteristics of the connector 102. Additionally, the resiliency of the beams 146 at the interface of the shield base 130 and the contact ring 132 facilitates accommodation of a greater board misalignment than known connectors.

As may also be seen in FIG. 3, the connector 102 has a lateral dimension $D_2$(i.e., an outer diameter in an exemplary embodiment) of approximately 4.55 mm, and thus occupies a relatively small space on the circuit boards 104 and 106 (shown in FIG. 1) relative to known coaxial connectors. That is, the connector 102 has a smaller footprint than known connectors and therefore occupies less space on the circuit boards.

Figure 4:
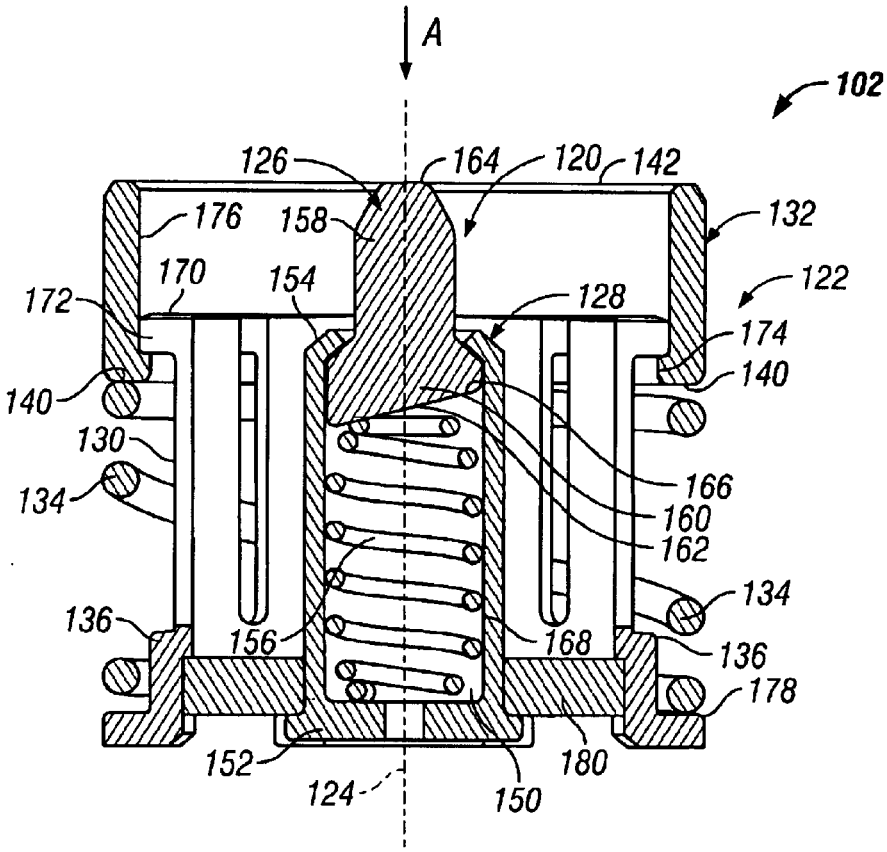
FIG. 4 is a cross sectional view of the connector shown in FIGS. 2 and 3.

FIG. 4 is a cross sectional view of the connector 102 illustrating the center contact assembly 120 substantially centered upon the longitudinal axis 124 of the connector 102. The housing 128 is integrally formed and is substantially cylindrical in an illustrative embodiment, and the housing 128 includes a hollow interior or bore 150 extending between a lower end 152 and an upper end 154. The plunger contact 126 is received in an upper end of the bore 150, and a spring element 156 extends within the bore 150 between the lower end 152 of the housing 128 and the plunger contact 126. The plunger contact 126 includes a bullet-shaped leading portion 158 extending from the housing 128 and a shoulder portion 160 having an engagement surface 162 interior to the housing 128. The engagement surface 162 is inclined or angled relative to the longitudinal axis 124, and the spring element 156 directly abuts or contacts the engagement surface 162. The shoulder portion 160 of the plunger contact 126 has an increased diameter relative to the leading portion 158, and the increased diameter of the shoulder portion 160 retains the plunger contact 126 to the upper end 154 of the housing which is tapered toward the longitudinal axis 124.

The spring element 156 in an illustrative embodiment is a helical compression spring, although another resilient spring element familiar to those in the art may likewise be employed in an alternative embodiment. The spring element 156 provides a biasing force against the engagement surface 162 of the shoulder portion 160 of the plunger contact 126. When the leading portion 158 of the plunger contact 126, and more specifically a tip 164 of the leading portion 158, is contacted by the target board 106 (shown in FIG. 1), the plunger contact 126 is depressible downward in the direction of arrow A into the bore 150 of the housing 128. Downward movement of the plunger contact 126 further compresses the spring element 156 to generate a normal contact force between the tip 164 of the leading portion 158 of the plunger contact 126 and the bottom surface 110 (shown in FIG. 1) of the target board 106.

In an exemplary embodiment, a conductive path is established through the center contact assembly 120 via contact between an outer surface 166 of the shoulder portion 160 of the plunger contact 126 and an inner surface 168 of the housing bore 150. As such, the spring element 156 in the housing 128 is not intended to be a current carrying element, but rather a signal path is established directly from the plunger contact 126 to the housing 128, which is mounted to the base board 104 (shown in FIG. 1) at the lower end 152.

The above-described construction of the center contact assembly 120 has a reduced number of parts in comparison to known center contact assemblies, which eliminates incremental costs in producing and assembling the connector 102. In particular, the integral housing 128 and direct engagement of the spring element 156 and the plunger contact 126 affords manufacturing and assembly advantages while avoiding potential reliability issues introduced by additional components.

An upper end 170 of the shield base 130 is outwardly flared or flanged to form an outwardly extending rim 172, and the contact ring 132 includes an inwardly extending lip 174 at the lower edge 140 thereof The rim 172 of the shield base 130 is in sliding engagement with an interior surface 176 of the cylindrical contact ring 132. The lip 174 of the contact ring 132 contacts the rim 170 of the shield base 130 in the extended position, and the lip 174 serves a stop and a retainer to maintain the contact ring 132 engaged to the shield base 130. The spring element 134 is seated on the lower edge 140 of the contact ring 132 and on an upper surface 178 of one of the footings 136 of the shield base 130 to bias the contact ring 132 in the extended position relative to the shield base 130.

In an exemplary embodiment, a conductive return path is established through the shield assembly 122 via contact between the rim 172 of the shield base 130 and the interior surface 176 of the contact ring 132. As such, the spring element 134 of the shield assembly 122 is not intended to be a current carrying element, but rather a return path is established directly from the shield base 130 to the interior surface 176 of the contact ring 132 via the rim 172 of the shield base 130.

When the contact ring 132 is contacted by the target board 106 (shown in FIG. 1), the contact ring 132 is depressible downward in the direction of arrow A. Downward movement of the contact ring 132 further compresses the spring element 134 to generate a normal contact force between the top surface 142 of the contact ring 132 and the bottom surface 110 (shown in FIG. 1) of the target board 106.

The lower end of the connector 102 is shielded by virtue of a dielectric disk 180 which surrounds the lower end of the center contact housing 128 and extends outward to the footings 136 of the shield base 130.

Figure 5:
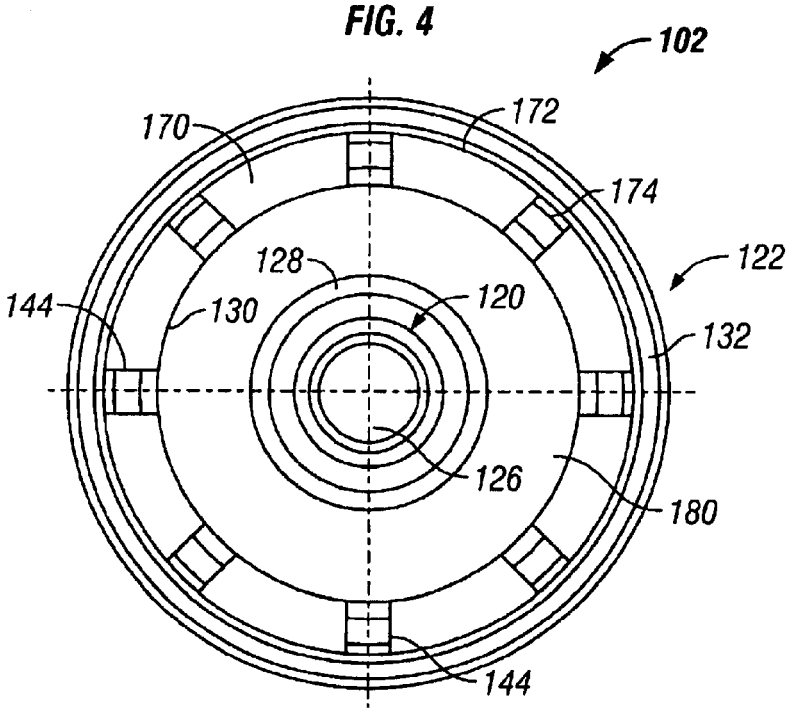
FIG. 5 is a top plan view of the connector shown in FIGS. 2–4.

FIG. 5 is a top plan view of the connector 102 illustrating the coaxial center contact assembly 120 and the shield assembly 122. The housing 128 of the center contact assembly 120 is positioned centrally in the connector 102 with the plunger contact 126 extending upward therefrom. The dielectric disk 180 surrounds the housing 138 at its lower end, and the contact ring 132 extends upward from the rim 172 of the shield base 130. The lip 174 of the contact ring 132 extends below the rim 170 of the shield base 130 to maintain the contact ring 132 to the shield base 130. The slots 144 in the shield base 130 extend through the upper end 170 of the shield base 130. As illustrated in FIG. 5, eight slots 144 are formed in the contact shield to produce desired RF shielding of a low profile connector, although it is appreciated that greater or lesser numbers of slots 144 may be employed in alternative embodiments. Eight slots 144, and hence eight contact beams 146 (shown in FIG. 3) has been found appropriate for a 4 mm connector 102 when in the retracted position as shown in FIG. 1 while achieving acceptable shielding and an optimum electrical resistance of the contact beams 146.

Figure 6:
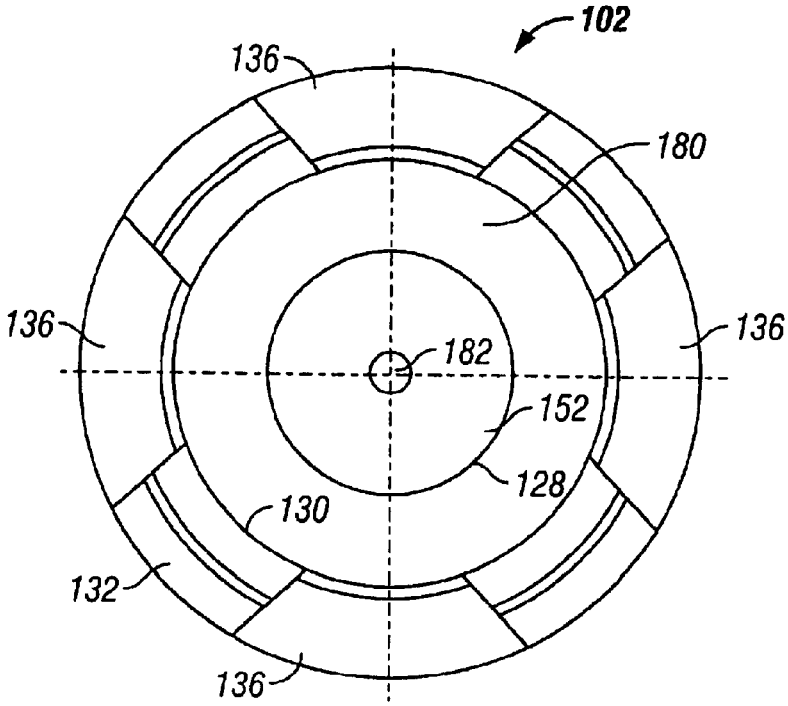
FIG. 6 is a bottom plan view of the connector shown in FIGS. 2–4.

FIG. 6 is a bottom plan view of the connector 102 illustrating the lower end 152 of the housing 128, and a through-hole or via 182 extends through the lower end 152 for establishing electrical connection thereto. The dielectric disk 180 surrounds the housing 128 and extends to the footings 136 which extend radially outwardly from the shield base 130. The contact ring 132 is coupled to the shield base 130 and has an outer dimension or profile approximately equal to the footings 136. While in an illustrative embodiment the shield base 130 includes four footings 136, greater or fewer numbers of footings may be employed in alternative embodiments of the invention.

Figure 7:
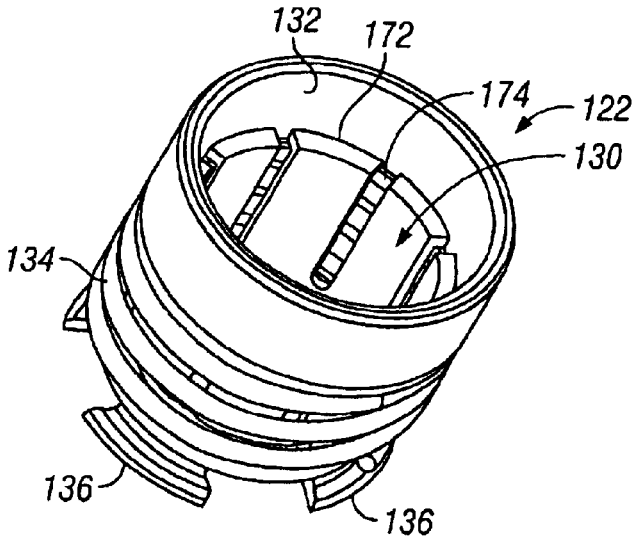
FIG. 7 is perspective view of a shield assembly formed in accordance with an exemplary embodiment of the invention.
Figure 8:
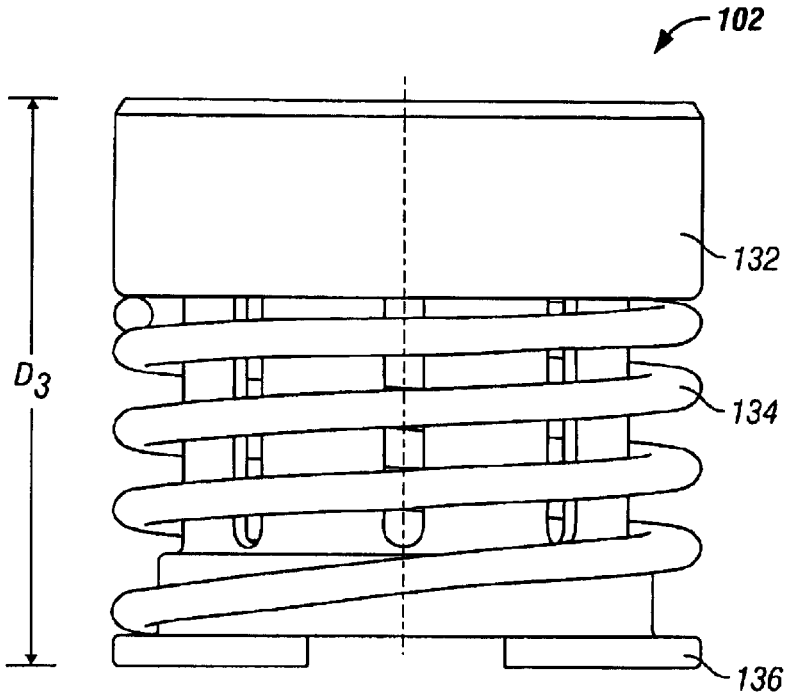
FIG. 8 is a side elevational view of the shield assembly shown in FIG. 7.
Figure 9:
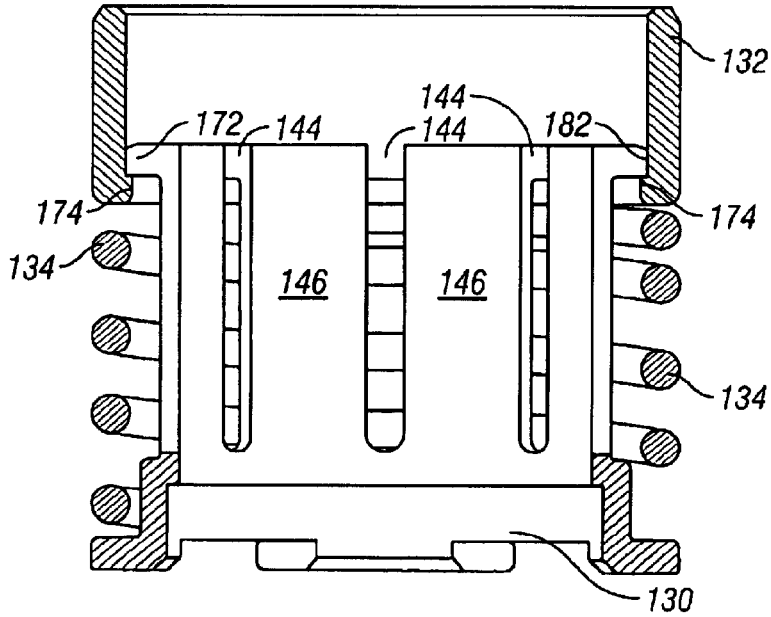
FIG. 9 is a cross sectional view of the shield assembly shown in FIGS. 7 and 8.

FIG. 7–9 illustrate the shield assembly 122 with the center contact assembly 120 (shown in FIGS. 2–6) removed. The lip 174 of the contact ring 132 is engaged to the rim 174 of the base shield 130. The spring element 134 extends exterior to the base shield 130, and the footings 136 extend from the lower end of the base shield 130. As seen in FIG. 8, the shield assembly 122 has an overall height $D_3$ of approximately 4.55 mm in the extended position. As best seen in FIG. 9, the slots 144 in the base shield 130 separate the upper portion of the base shield 130 into contact beams 146. The beams 146 provide multiple electrical paths in parallel between the shield base 130 and the contact ring 132. The establishment of multiple conductive paths minimizes the electrical resistance of the interface (at the shield base rim 172) between the shield base 130 and the contact ring 132.

Figure 10:
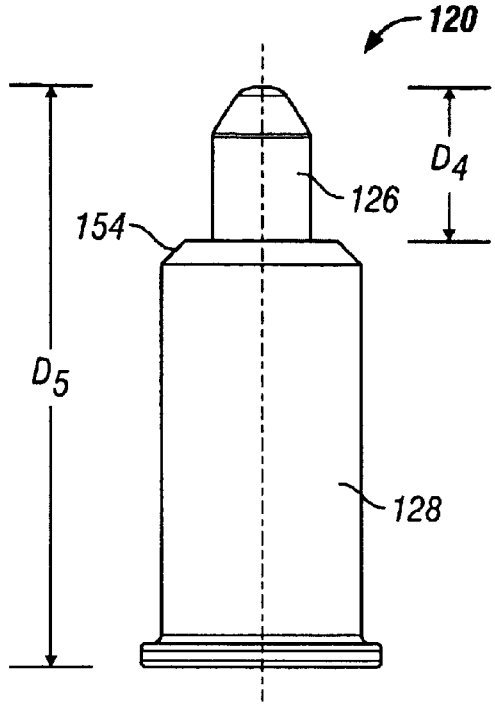
FIG. 10 is a side elevational of a center contact assembly shown formed in accordance with an exemplary embodiment of the invention.

FIG. 10 is a side elevational of the center contact assembly 120 illustrating the center plunger contact 126 extending from the housing 128 at the upper end 154. In an illustrative embodiment, the plunger contact 126 extends from the housing 128 for an axial distance $D_4$ of about 1.2 mm, while the contact assembly 120 has an overall height of about 4.5 mm. It is therefore noted that $D_5$ is slightly less than the height $D_3$ of the shield assembly 122 (shown in FIG. 8). Thus, the target board 106 (shown in FIG. 1) will always contact the contact ring 132 (shown in FIG. 8) of the shield assembly 122 before the target board contacts the plunger contact 126.

Figure 11:
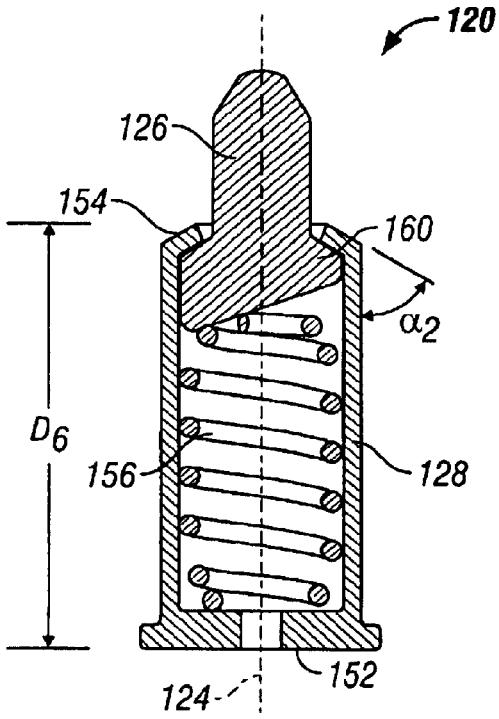
FIG. 11 is a cross sectional view of the center contact assembly shown in FIG. 10.

FIG. 11 is a cross sectional view of the center contact assembly 120 wherein it may be seen that the housing 128 has an overall height $D_6$ of about 3.3 mm between its upper and lower ends 152, 154, respectively. The upper end 154 includes tapered sides extending at an angle $\alpha_2$ of approximately 45° relative to the longitudinal axis 124 to retain a complementary shaped outer profile of the shoulder portion 160 of the plunger contact 126. The spring element 156 maintains the plunger contact 126 in position relative to the housing 128.

Figure 12:
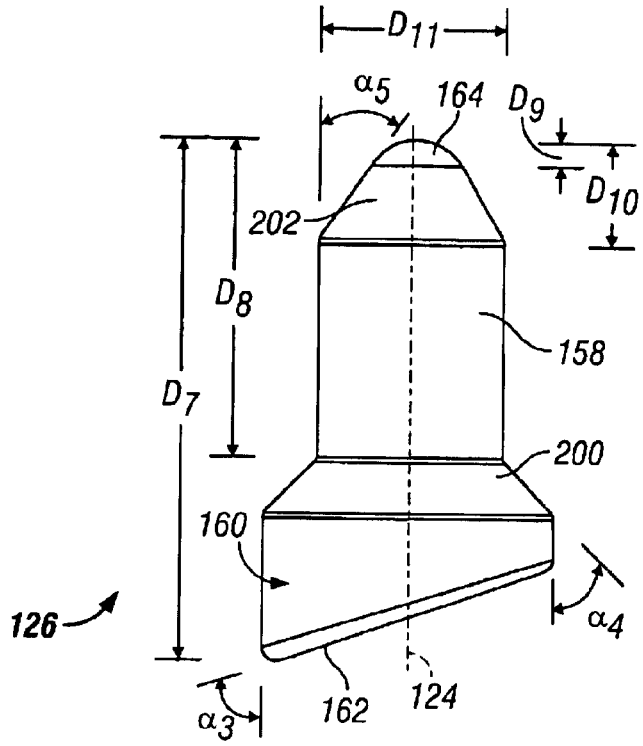
FIG. 12 is a side elevational view of the plunger contact shown in FIGS. 10 and 11.

FIG. 12 is a detail view of an exemplary low profile plunger contact 126 including the shoulder portion 160, a neck portion 200 extending from the shoulder portion 160, the leading portion 158 extending from the neck portion 200, a transition portion 202 extending from the leading portion 202, and a rounded tip 164 extending from the transition portion 202.

In an exemplary embodiment, the shoulder portion 160 includes the spring engagement surface 162 extending at an angle $\alpha_3$ of approximately 700 relative to the longitudinal axis 124. The neck portion 200 includes tapered sides extending at an angle $\alpha_4$ of approximately 45° relative to the longitudinal axis 124 to the leading portion 158. The transition portion 202 includes tapered leading sides extending at an angle $\alpha_5$ of approximately 30° relative to the longitudinal axis 124 to the rounded tip 164. The plunger contact 126 has an overall axial length $D_7$ of approximately 2.025 mm, of which an axial distance $D_8$ of about 1.23 mm extends from the neck portion 200 to the tip 164. The tip 164 extends for an axial length $D_9$ of approximately 0.09 mm, and the transition portion 202 extends for an axial length $D_{10}$ of about 0.41 mm in an exemplary embodiment. The leading portion 158 has a lateral dimension $D_{11}$, measured perpendicular to the longitudinal axis 124, of about 0.75 mm in an exemplary embodiment. While the exemplary dimensions and configuration of the described plunger contact 126 have been found satisfactory for a 4 mm connector in the retracted position, it is contemplated that the shape and relative dimensions of the plunger contact 126 may be varied in further and/or alternative embodiments of the invention.

Figure 13:
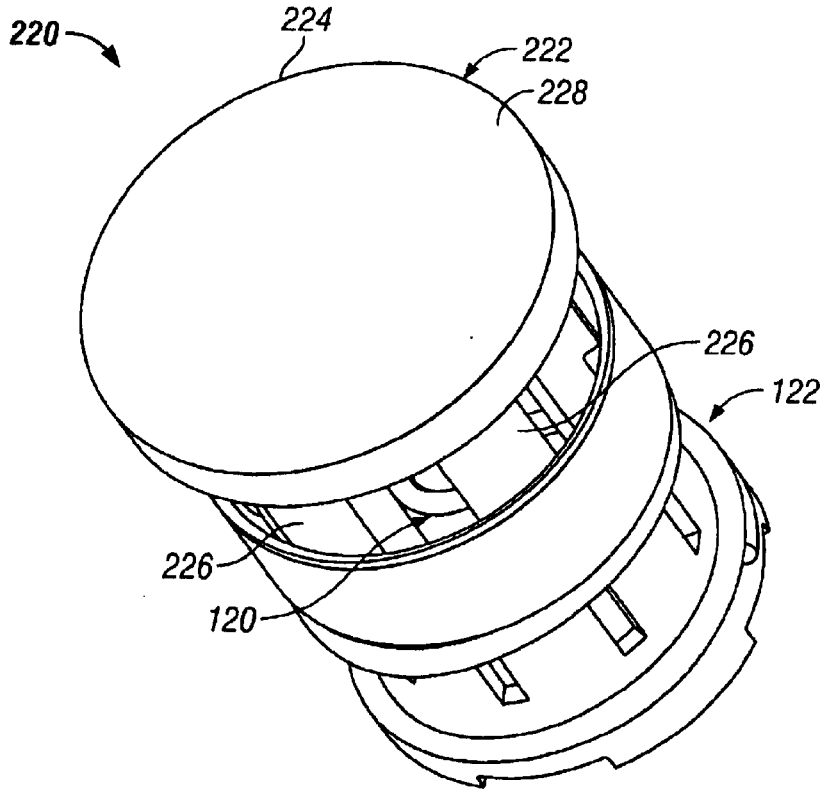
FIG. 13 is a perspective view of a second embodiment of a board-to-board coaxial connector formed in accordance with an exemplary embodiment of the invention.
Figure 14:
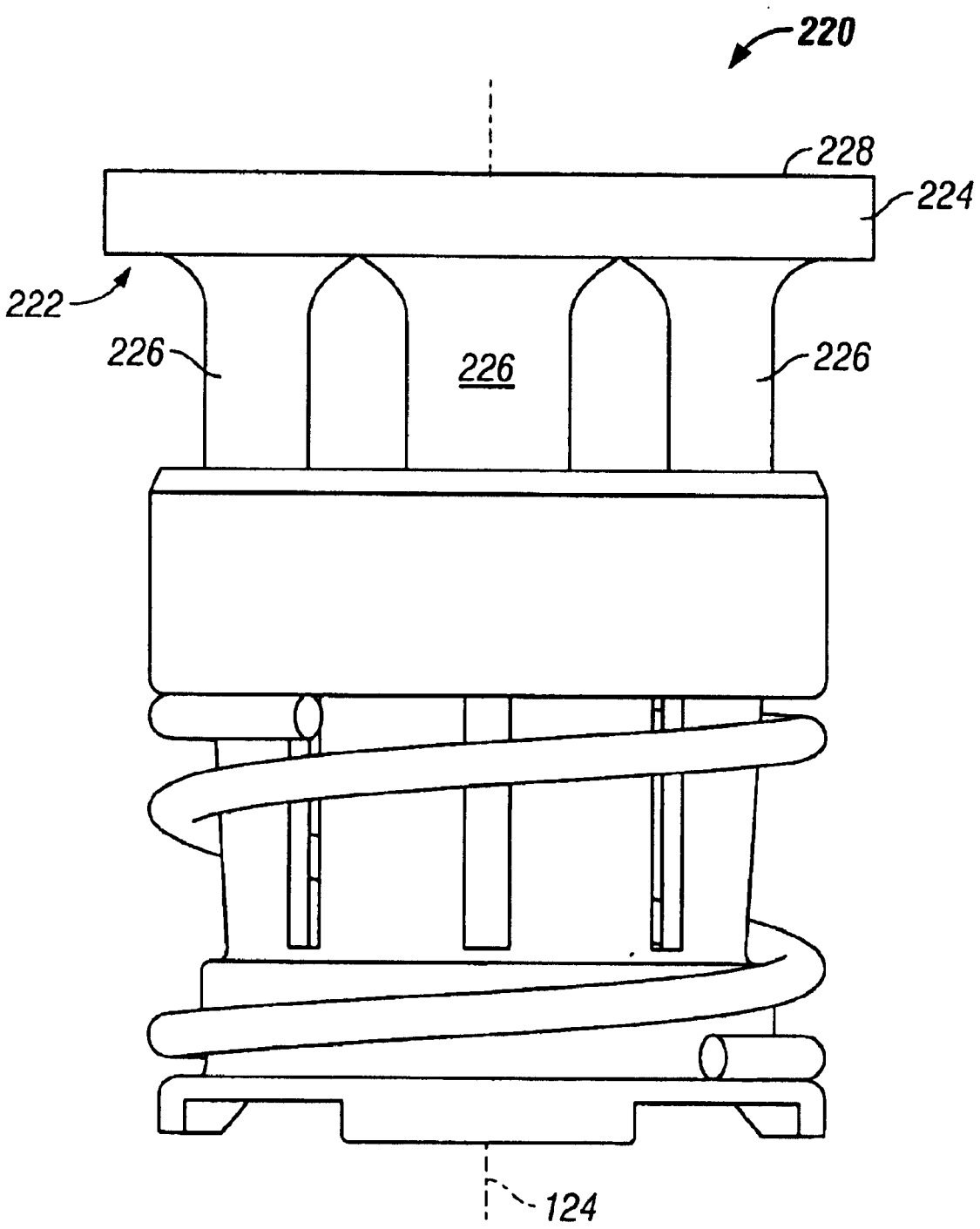
FIG. 14 is a side elevational view of the connector shown in FIG. 13.
Figure 15:
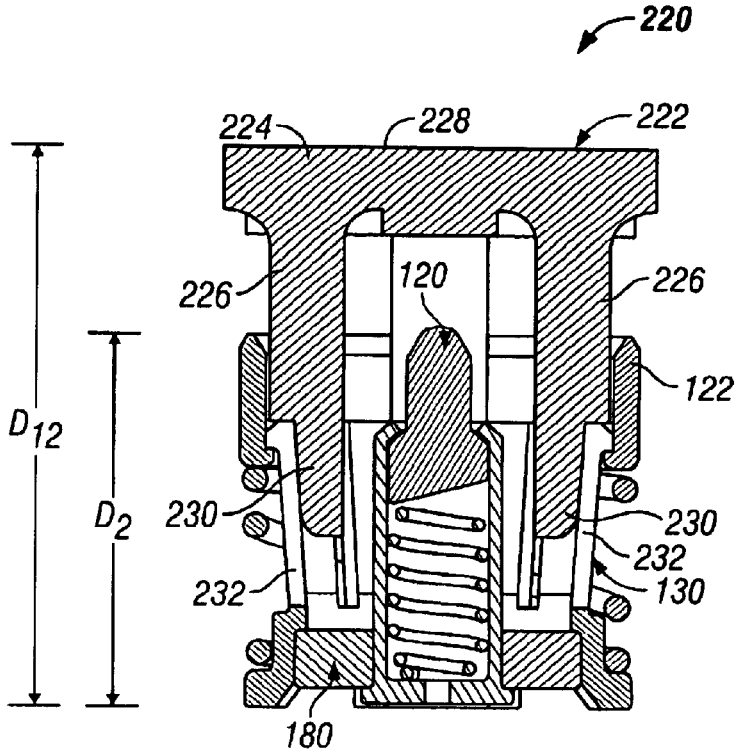
FIG. 15 is a cross sectional view of the connector shown in FIG. 14.

FIGS. 13–15 illustrate a second embodiment of a board-to-board coaxial connector 220 formed in accordance with an exemplary embodiment of the invention. Except as otherwise noted, the connector 220 is substantially similar to the connector 102 (shown in FIGS. 1–12), and like features of the connector 220 and the connector 102 are indicated with like reference characters.

The connector 220 includes a center contact assembly 120, a shield assembly 122, and a cover 222 having a substantially circular cap 224 and a plurality of attachment legs 226 extending from the cap 224 into the shield assembly 122 to securely couple the cover 222 to the connector 220 as described below. The cap 224 includes a substantially flat and unobstructed top surface 228 extending above the center contact assembly 120 and the shield assembly 122. The flat top surface 228 facilitates vacuum pick up with surface mount technology assembly equipment for automated placement and installation of the connector 220 to a circuit board, such as the base board 104 shown in FIG. 1.

As best seen in FIG. 15, the attachment legs 226 of the cover 222 include tapered leading ends 230 which engage an interior surface 232 of the shield base 130. The cover 222 is press fit to the shield base 130 to form an interference fit therewith such that when the cover 222 is lifted, the entire connector 220 is also lifted and the connector 220 may be positioned as desired for installation. Once the connector 220 is installed, the cover 222 is removed, and the shield assembly 122 and the center contact assembly 120 may be engaged to another circuit board, such as the target board 106 (shown in FIG. 1).

Also as seen in FIG. 15, when the cover 222 is attached to the shield assembly 122, the connector 220 has an overall height $D_{12}$ of approximately 6.85 mm compared to the overall height $D_2$ of about 4.55 mm of the center contact assembly 120 and the shield assembly 122.

Figure 16:
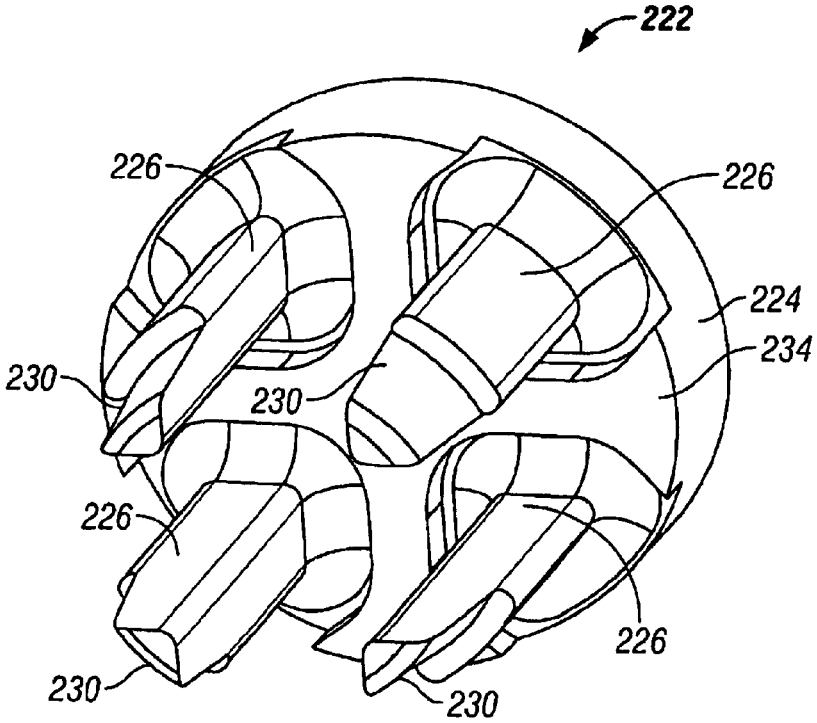
FIG. 16 is bottom perspective view of a cover for the connector shown in FIGS. 13–15.

FIG. 16 is bottom perspective view of the cover 222 illustrating four attachment legs 226 extending substantially perpendicular to a bottom surface 234 of the cap 224. The legs 226 include a substantially triangular outer profile with the leading ends 230 tapered inwardly toward the center of the cap 224. It is understood that greater or fewer numbers of legs 226 and alternative shapes of the legs 226 may be employed in further and/or alternative embodiments.

Figure 17:
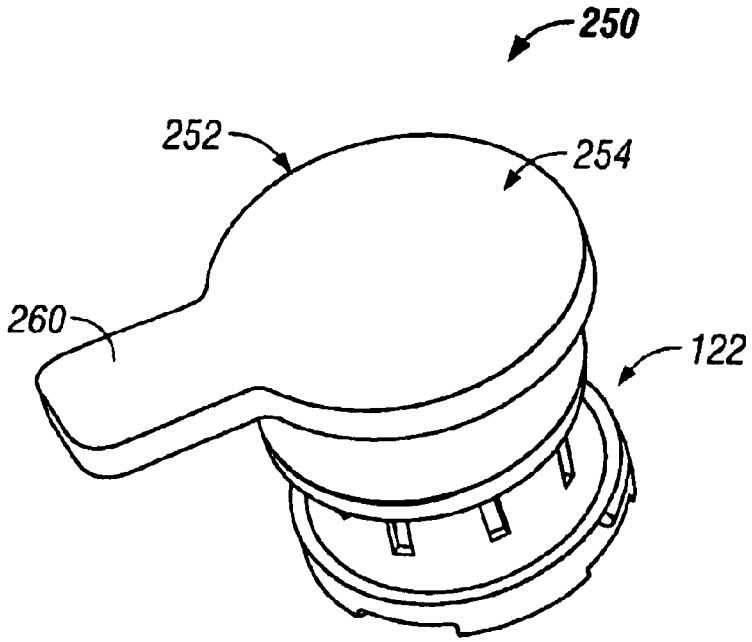
FIG. 17 is a perspective view of a third embodiment of a board-to-board coaxial connector formed in accordance with an exemplary embodiment of the invention.
Figure 18:
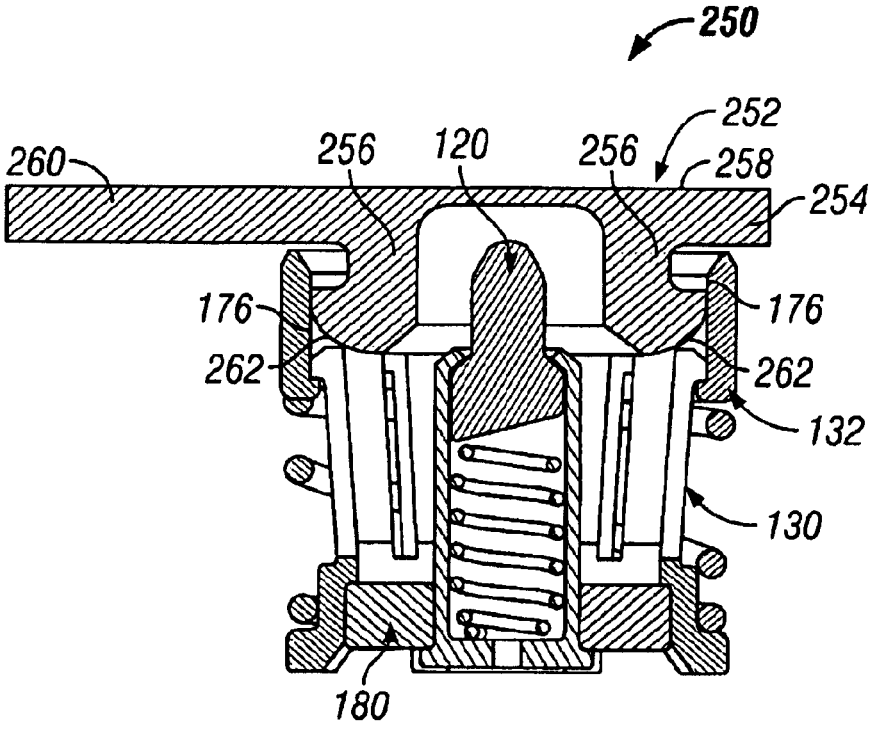
FIG. 18 is a cross sectional view of the connector shown FIG. 17.

FIGS. 17 and 18 illustrate a third embodiment of a board-to-board coaxial connector 250 formed in accordance with an exemplary embodiment of the invention. Except as otherwise noted, the connector 250 is substantially similar to the connector 102 (shown in FIGS. 1–12), and like features of the connector 250 and the connector 102 are indicated with like reference characters.

The connector 250 includes a center contact assembly 120, a shield assembly 122, and a cover 252 having a substantially circular cap 254 and a substantially cylindrical collar 256 extending from the cap 254 into the shield assembly 122 to securely couple the cover 222 to the connector 220 as described below. The cap 254 includes a substantially flat and unobstructed top surface 258 extending above the center contact assembly 120 and the shield assembly 122. The flat top surface 258 facilitates vacuum pick up with surface mount technology assembly equipment for automated placement and installation of the connector 250 to a circuit board, such as the base board 104 shown in FIG. 1.

The cap 254 also includes a substantially rectangular extension handle 260 projecting radially outwardly from the cap 224. The handle 260 provides an additional gripping surface for installation and removal of the cover, or for manipulating the connector 250 when the cover 252 is attached.

As best seen in FIG. 18, the collar 256 of the cover 252 includes an outwardly flared leading edge 262 which engages the interior surface 176 of the contact ring 132. The cover 252 is press fit to the contact ring 132 to form an interference fit therewith such that when the cover 252 is lifted, the entire connector 250 is also lifted and the connector 250 may be positioned as desired for installation. Once the connector 250 is installed, the cover 252 is removed, and the shield assembly 122 and the center contact assembly 120 may be engaged to another circuit board, such as the target board 106 (shown in FIG. 1).

Figure 19:
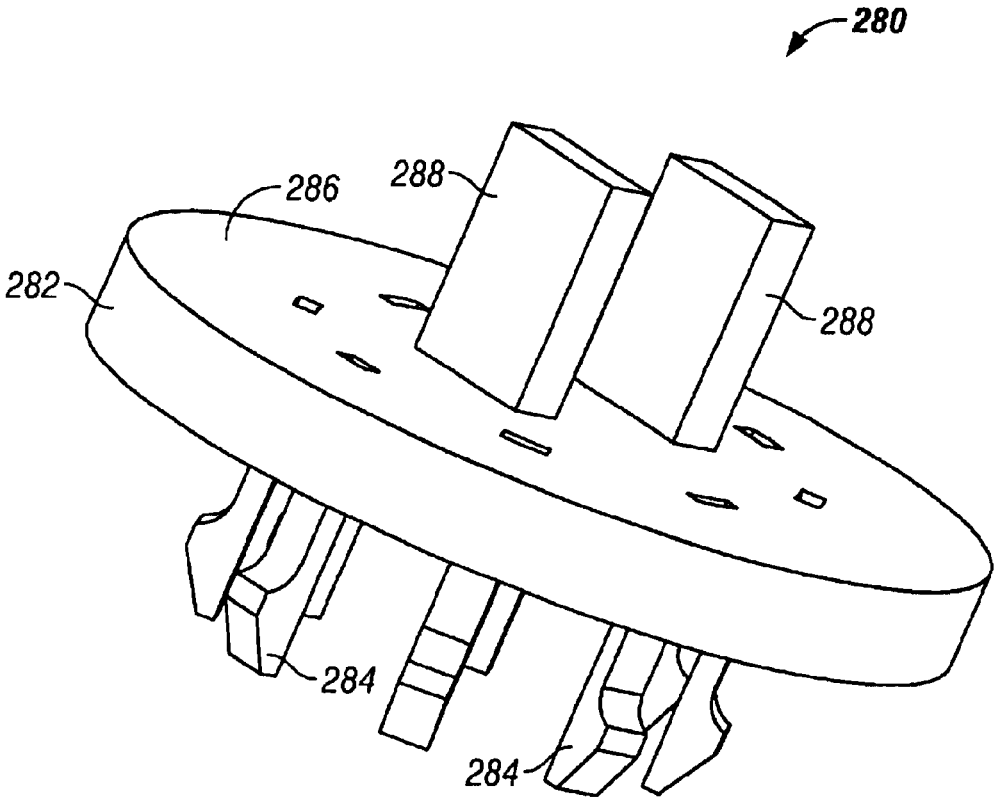
FIG. 19 is a perspective view of a cover for a board-to-board coaxial connector.

FIG. 19 is a perspective view of another embodiment of a cover 280 for a board-to-board coaxial connector, such as the connector 102 (shown in FIGS. 1–12). The cover 280 includes a substantially circular cap 282 and a plurality of attachment legs 284 extending from the cap 224, which may be extended into a shield assembly (not shown in FIG. 19) to securely couple the cover 280 to a connector. The cap 282 includes a substantially flat top surface 286 which facilitates vacuum pick up with surface mount technology assembly equipment for automated placement and installation of the associated connector to a circuit board, such as the base board 104 shown in FIG. 1.

The cap 282 also includes a pair of upstanding substantially rectangular posts 288 projecting upwardly from the top surface 286. The posts 288 provide an additional gripping surface for pick and place equipment or vacuum pickup, installation and removal of the cover, or for manipulating a connector when the cover 280 is attached.

Figure 20:
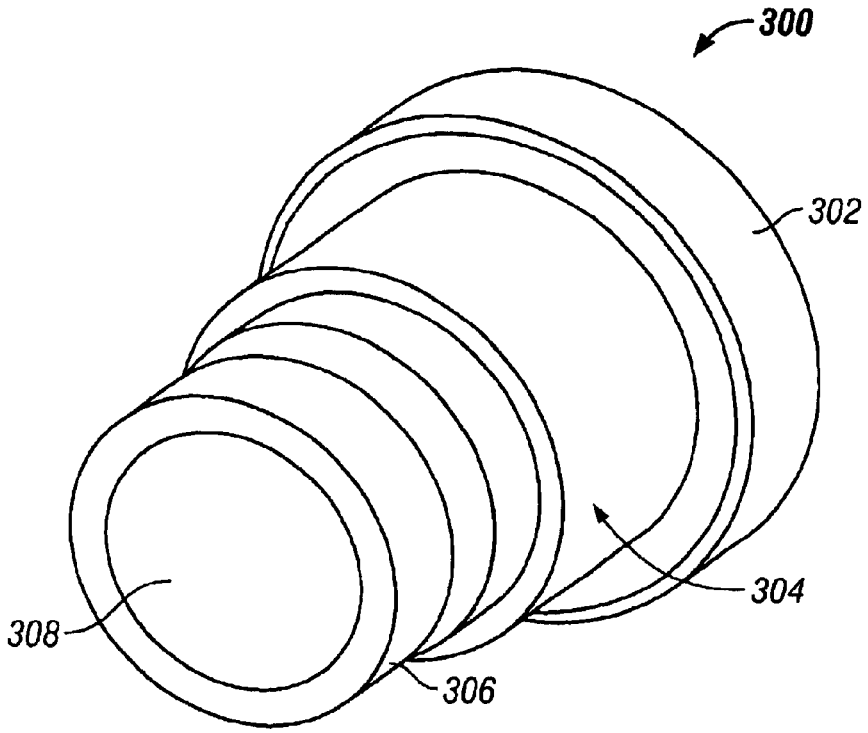
FIG. 20 is a perspective view of a cover for a board-to-board coaxial connector.
Figure 21:
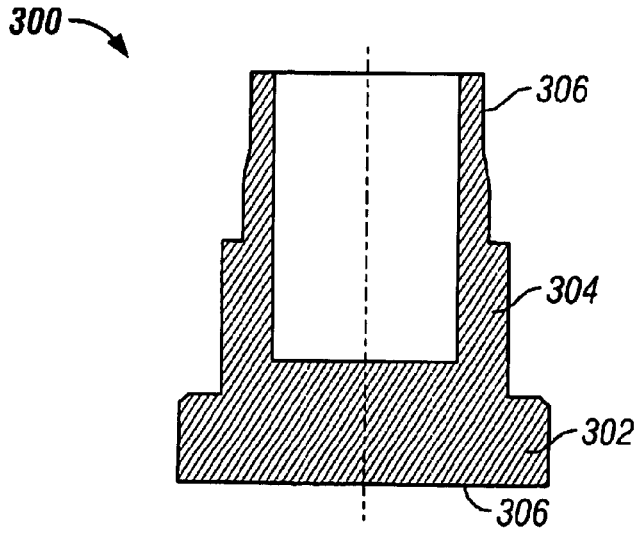
FIG. 21 is a cross sectional view of the cover shown in FIG. 20.

FIGS. 20 and 21 illustrate another exemplary embodiment of a cover 300 for a board-to-board coaxial connector, such as connector 102 (shown in FIGS. 1–12).

The cover 300 includes a substantially circular cap 302 and a substantially cylindrical collar 304 extending from the cap 302 into a shield assembly, (not shown in FIG. 19), such as the shield assembly 122 described above, to securely couple the cover 300 to the connector 102 as described below. The cap 302 includes a substantially flat and unobstructed top surface 306 extending above the center contact assembly 120 and the shield assembly 122. The flat top surface 306 facilitates vacuum pick up with surface mount technology assembly equipment for automated placement and installation of the connector 102 to a circuit board, such as the base board 104 shown in FIG. 1.

The collar 304 includes an inwardly tapered leading edge 306 which engages an interior surface 232 (shown in FIG. 15) of the shield base 130. The cover 300 is press fit to the shield base 130 to form an interference fit therewith such that when the cover 300 is lifted, the associated connector is also lifted and the connector may be positioned as desired for installation. Once the connector is installed, the cover 300 is removed, and the shield assembly 122 and the center contact assembly 120 may be engaged to another circuit board, such as the target board 106 (shown in FIG. 1).

While the invention has been described in terms of various specific embodiments, those skilled in the art will recognize that the invention can be practiced with modification within the spirit and scope of the claims.

What is claimed is:

1. A low profile electrical connector comprising:

a center contact assembly comprising an integral housing and a spring loaded plunger contact therein; and a shield assembly coaxial with said center contact assembly, said shield assembly comprising a slotted shield base adapted to be coupled stationary to a circuit board, and a contact ring reciprocally mounted to said shield base for relative movement thereto.

2. A low profile electrical connector in accordance with claim 1 wherein said plunger contact and said contact ring are depressible against a bias of respective spring elements, said plunger contact and said contact ring depressible to provide an overall height of the connector of about 4 mm in a retracted position.

3. A low profile electrical connector in accordance with claim 1 wherein said slotted shield base comprises a substantially cylindrical body extending along a longitudinal axis and having at least eight longitudinally extending contact beams.

4. A low profile electrical connector in accordance with claim 1 wherein said slotted shield base comprises a plurality of footings extending therefrom.

5. A low profile electrical connector in accordance with claim 1 wherein said center contact assembly comprises a spring, said spring directly contacting an engagement surface of said plunger contact.

6. A low profile electrical connector in accordance with claim 1 wherein said connector comprises a longitudinal axis, said plunger contact comprising an engagement surface which is inclined relative to said longitudinal axis, said engagement surface extending at substantially a 75 degree angle with respect to the longitudinal axis.

7. A low profile electrical connector in accordance with claim 1 wherein said center contact assembly and said shield assembly are adapted to accept a board-to-board misalignment of about 3 degrees between a first circuit board and a second circuit board.

8. A low profile electrical connector in accordance with claim 1 further comprising a cover removably coupled to said shield assembly, said cover comprising a substantially flat top surface.

9. A low profile electrical connector in accordance with claim 8 wherein said top surface includes a substantially circular perimeter, said cover comprising an extension portion radially projecting outward from said substantially circular perimeter.

10. A low profile electrical connector in accordance with claim 8 wherein said cover further includes at least one finger grip or vacuum pickup surface extending upwardly from said top surface.

11. A low profile coaxial electrical connector comprising:

a substantially cylindrical center contact assembly comprising an integral conductive housing, a contact plunger reciprocally mounted within said housing, and a first spring biasing said plunger contact to an extended position relative to said housing, said plunger contact depressible against a bias of said first spring to a retracted position;

a substantially cylindrical shield assembly coaxial with said center contact assembly, said shield assembly comprising a slotted shield base having an outer surface and adapted to be fixedly coupled to a circuit board, a contact ring reciprocally mounted to said shield base and movable thereto, and a second spring biasing said contact ring to an extended position relative to said shield base, said contact ring depressible against a bias of said second spring to a retracted position;

wherein said plunger contact and said contact ring are depressed to produce an overall height of the connector of about 4 mm when said plunger contact and said slotted member are in said retracted position.

12. A low profile electrical connector in accordance with claim 11 wherein said slotted shield base comprises a substantially cylindrical body extending along a longitudinal axis and having at least eight longitudinally extending contact beams, thereby providing multiple conductive paths in parallel through said shield base.

13. A low profile electrical connector in accordance with claim 11 wherein said slotted shield base comprises a plurality of footings extending therefrom.

14. A low profile electrical connector in accordance with claim 11 wherein said plunger contact comprises an engagement surface, said first spring directly contacting said engagement surface.

15. A low profile electrical connector in accordance with claim 11 wherein said connector comprises a longitudinal axis, said plunger contact comprising an engagement surface which is inclined relative to said longitudinal axis, said engagement surface extending at substantially a 75 degree angle with respect to the longitudinal axis.

16. A low profile electrical connector in accordance with claim 11 wherein said center contact assembly and said shield assembly are adapted to accept a board-to-board misalignment of about 3 degrees between a first circuit board and second circuit board.

17. A low profile electrical connector in accordance with claim 11 further comprising a cover removably coupled to said shield assembly, said cover comprising a substantially flat top surface.

18. A low profile coaxial electrical connector comprising:

a substantially cylindrical center contact assembly comprising an integral conductive housing, a contact plunger reciprocally mounted within said housing, and a first spring biasing said plunger contact to an extended position relative to said housing, said plunger contact depressible against a bias of said first spring to a retracted position; and a substantially cylindrical shield assembly coaxial with said center contact assembly, said shield assembly comprising a slotted shield base having an outer surface and adapted to be fixedly coupled to a circuit board, a contact ring reciprocally mounted to said shield base and movable thereto, and a second spring biasing said contact ring to an extended position relative to said shield base, said contact ring depressible against a bias of said second spring to a retracted position;

wherein said center contact assembly and said shield assembly are adapted to accept a board-to-board misalignment of about 3 degrees between a first circuit board and second circuit board.

19. A low profile electrical connector in accordance with claim 18 wherein said slotted shield base comprises a substantially cylindrical body extending along a longitudinal axis and having at least eight longitudinally extending contact beams.

20. A low profile electrical connector in accordance with claim 18 wherein said slotted shield base comprises a plurality of footings extending therefrom.

21. A low profile electrical connector in accordance with claim 18 wherein said plunger contact comprises an engagement surface, said first spring directly contacting said engagement surface.

22. A low profile electrical connector in accordance with claim 18 wherein said connector comprises a longitudinal axis, said plunger contact comprising an engagement surface which is inclined relative to said longitudinal axis, said engagement surface extending at substantially a 75 degree angle with respect to the longitudinal axis.

23. A low profile electrical connector in accordance with claim 18 further comprising a cover removably coupled to said contact ring, said cover comprising a substantially flat top surface.

24. An electronic package comprising:

a first circuit board and a second board having a separation therebetween;

a shield assembly mounted stationary to said first circuit board, said shield assembly comprising a slotted shield base coupled stationary to said first circuit board, and a contact ring reciprocally mounted to said shield base for relative movement thereto from an extended position relative to said first circuit board to a retracted position when contacted by said second circuit board; and a center contact assembly coaxial with and internal to said shield assembly, said center contact assembly comprising an integral housing mounted stationary to said first circuit board and a spring loaded plunger contact reciprocally coupled to said housing and movable between an extended position and a retracted position relative to said housing, said plunger contact depressed by said second circuit board to establish electrical connection therewith.

25. An electronic package in accordance with claim 24 wherein said separation is about 4 mm or less.

* * * * *